United States Patent [19]

Karlström

[11] 4,443,983

[45] Apr. 24, 1984

[54] MEANS FOR FASTENING A FRAME TO A WALL STUD

[76] Inventor: Tore Karlström, Snellmansgränd 5, 22150 Jomala, Finland

[21] Appl. No.: 383,331

[22] Filed: May 28, 1982

[30] Foreign Application Priority Data

Jun. 16, 1981 [FI] Finland ..... 811887

[51] Int. Cl.[3] ..... E06B 1/04

[52] U.S. Cl. ..... 52/210; 52/364

[58] Field of Search ..... 52/210, 204, 213, 205, 52/364, 730, 376

[56] References Cited

U.S. PATENT DOCUMENTS 1,475,409 11/1923 Riddle ..... 52/376

2,062,399 11/1935 Coddington ..... 52/376

2,374,623 9/1943 Sale ..... 52/376

*Primary Examiner*—John E. Murtagh

*Assistant Examiner*—Kathryn L. Ford

*Attorney, Agent, or Firm*—Murray Schaffer

[57] ABSTRACT

The invention relates to a means for fastening a frame to a wall stud. In order to avoid the use of wooden studs between the frame (7) and the steel stud (6) there is arranged in those locations in the steel stud (5) where the frame (7) is fastened to the stud by means of a screw (13) a stud piece (14) whose web through which the screw (13) is passed is provided with a reinforcing plate (15) which together with the web provides a sufficiently thick wall for a stable securing of the screw (13).

3 Claims, 3 Drawing Figures

MEANS FOR FASTENING A FRAME TO A WALL STUD

The present invention relates to a means for fastening a frame to a wall stud, said stud having a substantially U-shaped cross-section.

It is known to construct walls by fastening runners in the floor and the ceiling between which vertical studs are positioned. Gypsum boards are thereupon fastened to flanges in the studs by means of screws extending through the boards and the flanges in the studs. However, when fastening door frames between the studs, special measures must be taken because of the mechanical load exerted on the frames in order to guarantee the stability of the studs and of the connection between frame and stud. If a steel stud having a material thickness of about 1.50 mm is chosen, the connecting screws can be fastened directly in the stud. However, this is a very expensive way and is used only for heavy doors, When using a standard steel stud having a material thickness of 0.56 mm, other means must be resorted to because the regulations prohibit the securing of a door frame in such a stud only. The conventional solution in this case is to arrange a wooden stud between the outside of the web of the steel stud and the frame whereby the connecting screws extend through the frame, the wooden stud and the web of the steel stud. In this case the wooden stud provides the stability required by the construction.

However, the use of wooden studs involves the disadvantage that the manufacturers must keep in stock and the wall will comprise an additional element, which can be avoided when using steel studs of a great material thickness. In addition, the fastening of the wooden stud in the ceiling and floor runners requires fastening means which differ from the fastening means by means of which the steel studs are fastened in the runners.

The object of the present invention is to provide a means which permits the fastening of a frame to standard steel studs which have been modified in an extremely simple manner. The means is characterized in that the open side of the stud faces the frame, that stud pieces which are substantially U-shaped in cross-section and are lockable to the stud are arranged along the stud in those locations where the frame is by means of screws fastened in the stud, and that a reinforcing plate is fastened on the web of said stud pieces. Thus, only standard studs are used in the means with the little exception that the reinforcing plate is fastened on the web of the stud pieces. The reinforcing plate has such a thickness that it together with the web of the stud piece forms a wall of a minimum thickness of 1.5 mm. In this way, a stable fastening of door frames in the studs is achieved by means of only a few elements and at a low cost.

Figure 1:
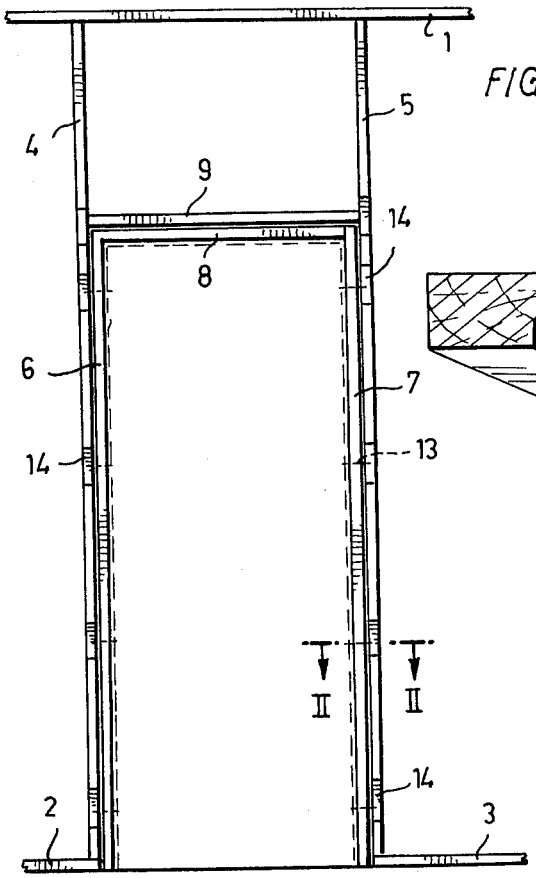
Figure 3:
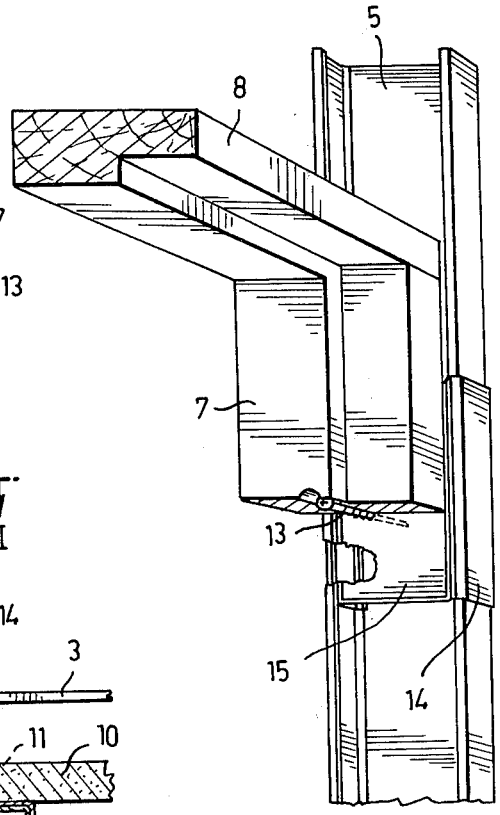
Figure 2:
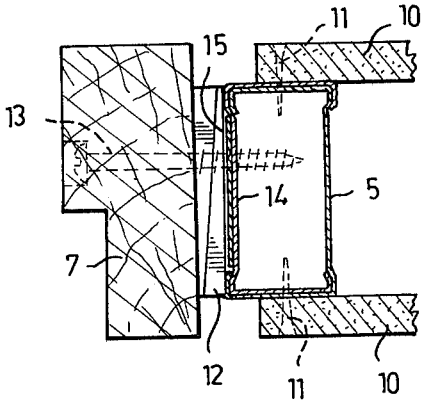

The invention will be described in more detail in the following with reference to the accompanying drawing, in which FIG. 1 illustrates a door fastening by means of the means according to the invention, FIG. 2 is a cross-section along the line II . . . II in FIG. 1 on an enlarged scale, and FIG. 3 is a perspective view of a part of the stud and the frame.

In FIG. 1 are seen a ceiling runner 1 and two floor runners 2 and 3. Between the ceiling and floor runners are fastened two vertical steel studs 4 and 5 at a mutual spacing which is somewhat larger than the width of the frame. The wooden frame comprises two vertical parts 6 and 7 and an upper horizontal part 8. A runner 9 is in a conventional manner secured to the studs 4, 5 above said horizontal part. FIG. 2, in addition, shows a section of the gypsum boards 10 which by means of screws 11 are fastened on the flanges of the steel frames 4, 5. In addition, two wedges 12 are in a conventional manner positioned between the frame parts 6, 7, 8 and the studs 4, 5 and the runner 9.

According to the invention, the steel studs 4, 5 are in those locations where the frame parts 6, 7 are to be fastened by means of a screw 13 to the studs provided with a stud piece 14 having a length of, e.g., 15 cm. Both the stud and the stud piece have the same, somewhat asymmetrical U-shaped cross-section which makes it possible to thread the stud piece on the stud so as to lock said piece to the stud. The stud piece has the same standard wall thickness as the stud itself, e.g., 0.56 mm and, in order to give the screw a sufficiently stable fastening base, a reinforcing plate 15, e.g., of sheet metal has been welded to the outside of the web of the stud piece. Said plate has such a thickness that it together with the wall thickness of the stud piece forms a sufficiently thick wall, e.g., 1.5 mm.

It is also conceivable for the stud to have a symmetrical U-shape and for the cross-sectional shape of the stud piece to differ from the cross-sectional shape of the stud. However, it must be possible to lock the stud piece either in or on the stud.

What I claim is:

1. A mount for attaching a frame such as a door or window frame to a wall stud having a substantially U-shaped cross-section, the open section of said stud facing the frame, said mount comprising a channel number having a length less than the length of said wall stud and a U-shaped cross section substantially conforming to that of said wall stud, said mount being superimposed over the open side of said stud with the respective side walls in abutment, means for joining the abutting side walls in fixed engagement and a reinforcing plate secured to the web interconnecting the side walls of said U-shaped channel member to which said frame may be fastened.

2. The mount according to claim 1 wherein said channel member and said reinforcing plate are made of metal, and said reinforcing plate is welded to said channel member.

3. The mount according to claim 1, wherein said channel member and said stud are asymmetrical in cross-section and formed to lockably engage in abutment.

* * * * *